US009329543B2

(12) United States Patent
Kanematsu et al.

(10) Patent No.: US 9,329,543 B2
(45) Date of Patent: May 3, 2016

(54) FIXING DEVICE COMPRISING SUPPORTING MEMBER HAVING SUPPORTING FACE CONFIGURED TO COME INTO CONTACT WITH INNER CIRCUMFERENCE FACE OF FIXING BELT AND IMAGE FORMING APPARATUS INCLUDING THE SAME

(71) Applicant: KYOCERA Document Solutions Inc., Osaka (JP)

(72) Inventors: Yoshiharu Kanematsu, Osaka (JP); Yoshihiro Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/627,387

(22) Filed: Feb. 20, 2015

(65) Prior Publication Data

US 2015/0248087 A1 Sep. 3, 2015

(30) Foreign Application Priority Data

Feb. 28, 2014 (JP) ..... 2014-037655

(51) Int. Cl.
*G03G 15/20* (2006.01)

(52) U.S. Cl.
CPC .... *G03G 15/2053* (2013.01); *G03G 2215/2022* (2013.01); *G03G 2215/2029* (2013.01); *G03G 2215/2041* (2013.01); *G03G 2215/2064* (2013.01)

(58) Field of Classification Search
CPC ..... G03G 15/2053; G03G 15/2064; G03G 2215/2016; G03G 2215/2022; G03G 2215/2029; G03G 2215/2041; G03G 2215/2064
See application file for complete search history.

(56) References Cited

U.S. PATENT DOCUMENTS

2007/0065194 A1* 3/2007 Kim ..... G03G 15/206 399/329
2013/0170878 A1* 7/2013 Kuroda ..... G03G 15/2053 399/329

FOREIGN PATENT DOCUMENTS

JP 10291672 A * 11/1998
JP 2003-302852 A 10/2003

* cited by examiner

*Primary Examiner* — David Gray
*Assistant Examiner* — Laura Roth
(74) *Attorney, Agent, or Firm* — Studebaker & Brackett PC

(57) ABSTRACT

A fixing device includes a fixing belt, a pressuring member, a heating member, a pressing member and a supporting member. The heating member is arranged rotatably around a rotation axis and configured such that the fixing belt is sandwiched between the heating member and the pressuring member. The pressing member is configured to press the fixing belt to a side of the pressuring member and configured such that the fixing belt is sandwiched between the pressing member and the pressuring member. The supporting member has a supporting face configured to come into contact with the inner circumference face of the fixing belt. The supporting face is inclined toward inside in a radial direction of the fixing belt from both end sides to a center side of the fixing belt in the rotation axis direction.

8 Claims, 8 Drawing Sheets

FIXING DEVICE COMPRISING SUPPORTING MEMBER HAVING SUPPORTING FACE CONFIGURED TO COME INTO CONTACT WITH INNER CIRCUMFERENCE FACE OF FIXING BELT AND IMAGE FORMING APPARATUS INCLUDING THE SAME

INCORPORATION BY REFERENCE

This application is based on and claims the benefit of priority from Japanese Patent application No. 2014-037655 filed on Feb. 28, 2014, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet. For the fixing device, a belt fixing manner is applied. The belt fixing manner is a manner to form a fixing nip by making a fixing belt and a pressuring member (e.g. a pressuring roller) come into pressure contact with each other.

For example, there is a fixing device including a fixing belt arranged rotatably, a pressuring member configured to come into pressure contact with the fixing belt so as to form a fixing nip, a heating member configured such that the fixing belt is sandwiched between the heating member and the pressuring member and a pressing member configured such that the fixing belt is sandwiched between the pressing member and the pressuring member.

In the fixing device configured as described above, an individual difference of each component or the like inevitably causes a force which moves the fixing belt to a side (one end side or the other end side). According to this, when the fixing belt is greatly moved to the side, there is a concern that the fixing belt comes into contact with a member arranged outside the fixing belt and thereby the fixing belt is buckled or damaged.

SUMMARY

In accordance with an embodiment of the present disclosure, a fixing device includes a fixing belt, a pressuring member, a heating member, a pressing member and a supporting member. The fixing belt is arranged rotatably. The pressuring member is arranged rotatably and configured to come into pressure contact with the fixing belt so as to form a fixing nip. The heating member is arranged rotatably around a rotation axis and configured such that the fixing belt is sandwiched between the heating member and the pressuring member. The pressing member is configured to press the fixing belt to a side of the pressuring member and configured such that the fixing belt is sandwiched between the pressing member and the pressuring member. The supporting member has a supporting face configured to come into contact with the inner circumference face of the fixing belt. The supporting face is inclined toward inside in a radial direction of the fixing belt from both end sides to a center side of the fixing belt in the rotation axis direction.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
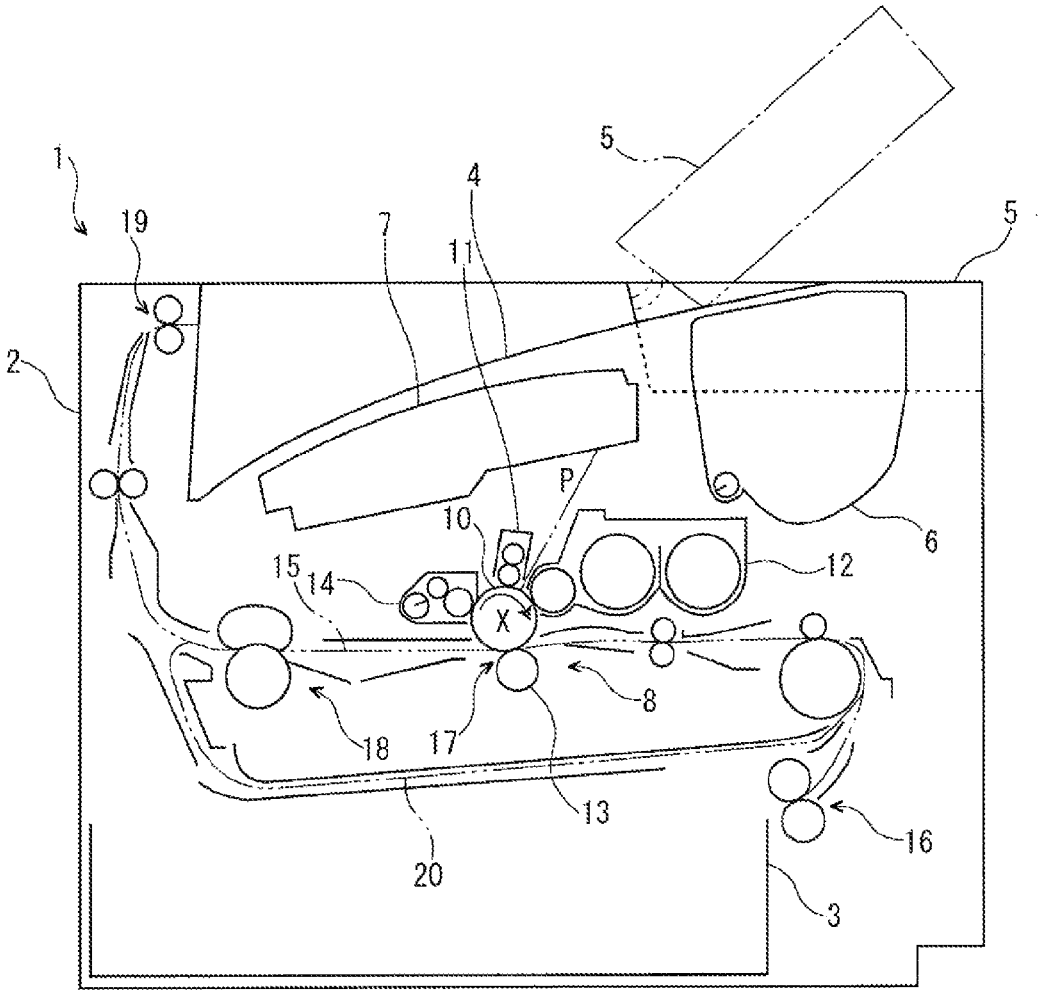
FIG. 1 is a schematic diagram showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Figure 2:
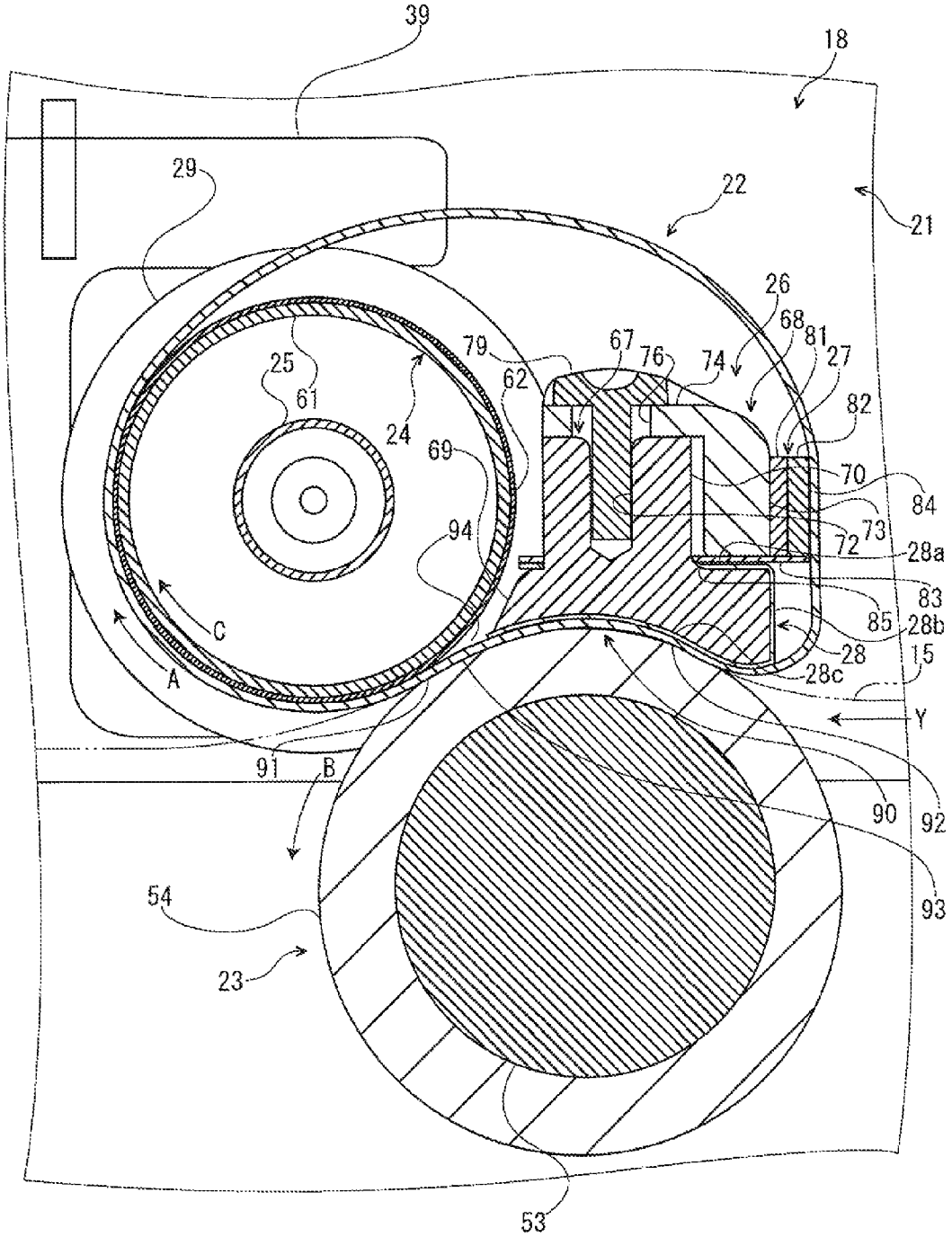
FIG. 2 is a sectional view showing a fixing device according to the embodiment of the present disclosure.

Next, the fixing device 18 will be described in detail with reference to FIGS. 2-5. For ease of description, a front side of FIG. 2 is a front side (front face side) of the fixing device 18. An arrow Y in FIG. 2 indicates a sheet conveying direction. An arrow Fr optionally assigned to each figure indicates a front side (front face side) of the fixing device 18. An arrow I in FIGS. 4A and 4B indicates an inside in forward and backward directions, and an arrow O in FIGS. 4A and 4B indicates an outside in the forward and backward directions.

Figure 3:
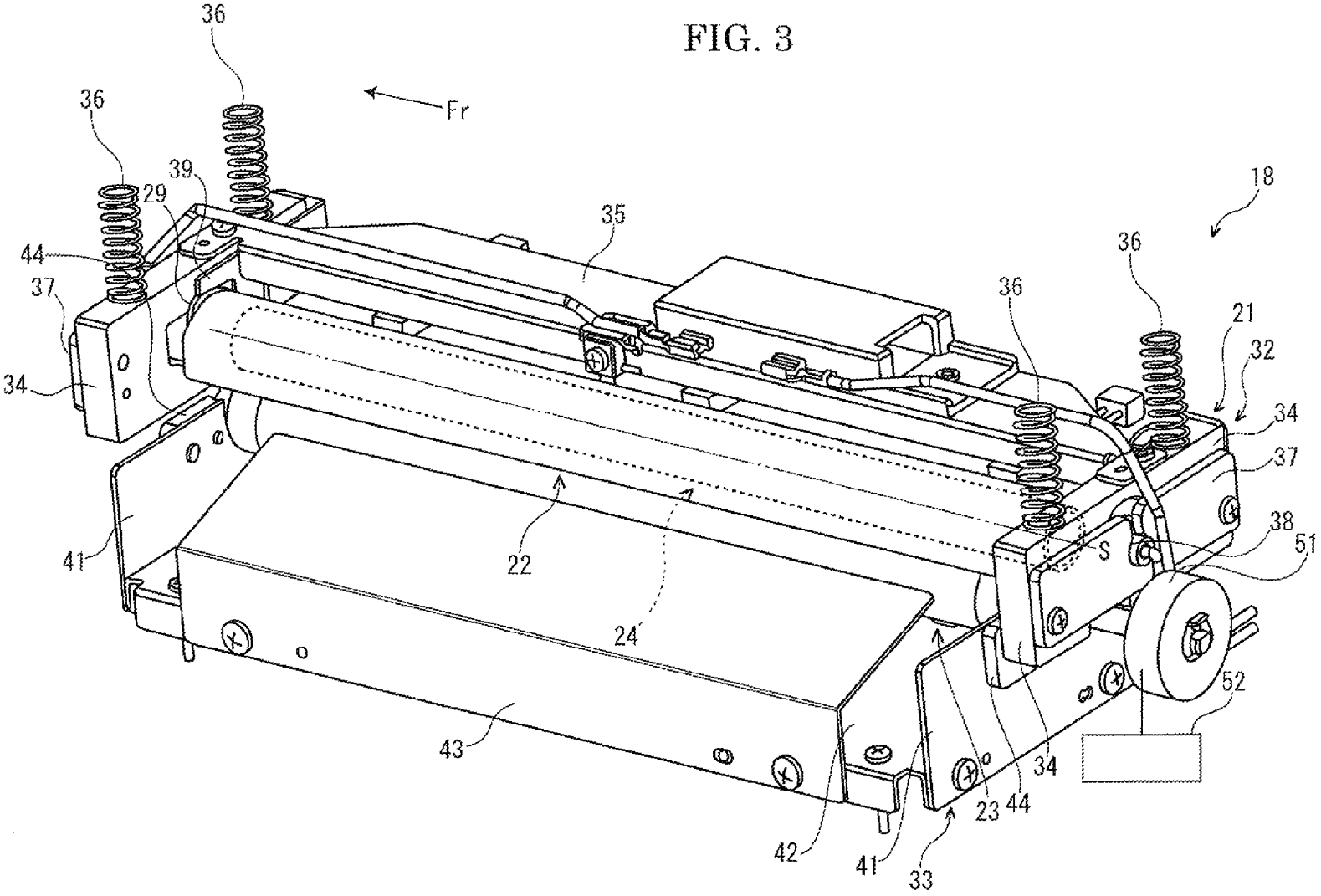
FIG. 3 is a perspective view showing the fixing device according to the embodiment of the present disclosure.

As shown in FIGS. 2 and 3, the fixing device 18 is provided with a fixing frame 21, a fixing belt 22 provided inside an upper part of the fixing frame 21, a pressuring roller 23 (pressuring member) provided inside a lower part of the fixing frame 21, a heating roller 24 (heating member) located inside the fixing belt 22 in a radial direction, a heater 25 (heat source) located inside the heating roller 24 in the radial direction, a pressing member 26 located at a right side (an upstream side in the sheet conveying direction) of the heating roller 24 and provided inside the fixing belt 22 in the radial direction, a supporting member 27 located at a right side (the upstream side in the sheet conveying direction) of the pressing member 26 and provided inside the fixing belt 22 in the radial direction, a sheet member 28 sandwiched between the fixing belt 22 and the pressing member 26, and flanges 29 located at both end sides in the forward and backward directions of the heating roller 24.

As shown in FIG. 3, the fixing frame 21 includes an upper frame 32 and a lower frame 33. The upper frame 32 is movable to upward and downward with respect to the lower frame 33.

The upper frame 32 of the fixing frame 21 is provided with a pair of front and rear upper side base plates 34 extending in a vertical direction. Upper end parts of a pair of front and rear upper side base plates 34 are coupled by a coupling frame 35. With a top face of each of the upper side base plates 34, lower end parts of a pair of left and right coil springs (biasing members) come into contact. The coil springs 36 bias the upper frame 32 to a lower side (a side of the lower frame 33). To an external face of each of the upper side base plates 34, supporting piece 37 is fixed. In a center part in left and right directions of each supporting piece 37, attachment groove 38 is formed. To an inner face of each of the upper side base plates 34, a regulating plate 39 is fixed.

The lower frame 33 of the fixing frame 21 is provided with a pair of front and rear lower side base plates 41 extending in the vertical direction. Lower parts of a pair of front and rear lower side base plates 41 are coupled by a coupling plate 42. To both left and right edge parts of the coupling plate 42, guide plates 43 are fixed. Each guide plate 43 is bent toward an inside in the left and right directions, and extends to the side of the pressuring roller 23. To an external face of each of the lower side base plates 41, a bearing plate 44 is fixed.

The fixing belt 22 is formed in a cylindrical shape elongated in the forward and backward directions. That is, in the present embodiment, the forward and backward directions are an axial line direction of the fixing belt 22. The fixing belt 22 is flexible. The fixing belt 22 is biased to the lower side (a side of the pressuring roller 23) by the above-mentioned coil springs 36.

As shown in FIG. 2, the fixing belt 22 is provided around the heating roller 24, the pressing member 26 and the supporting member 27 in a state where an upper part of the fixing belt 22 is loose. The fixing belt 22 is arranged rotatably. An arrow A in FIG. 2 indicates a rotation direction of the fixing belt 22.

The fixing belt 22 has a diameter of 24 mm, for example. The fixing belt 22 is provided with, for example, a base material layer, an elastic layer provided around this base material layer and a release layer covering this elastic layer. The base material layer of the fixing belt 22 is made of PI (polyimide) having a thickness of 50 μm, for example. The elastic layer of the fixing belt 22 is made of silicon rubber having a thickness of 200 μm, for example. The release layer of the fixing belt 22 is made of a PFA coating having a thickness of 10 μm, for example. In addition, in each figure, each layer (the base material layer, the elastic layer and the release layer) of the fixing belt 22 is not distinguished.

The pressuring roller 23 is formed in a columnar shape elongated in the forward and backward directions. As shown in FIG. 3 and the other figures, the pressuring roller 23 is located at a lower side (outside in a radial direction) of the fixing belt 22. The both front and rear end parts of the pressuring roller 23 are axially supported by the respective bearing plates 44 of the lower frame 33. Consequently, the pressuring roller 23 is rotatably supported by the lower frame 33. To the rear end part of the pressuring roller 23, a transmission gear 51 is fixed. The transmission gear 51 is connected to a driving source 52 such as a motor. According to this configuration, the driving source 52 is connected to the pressuring roller 23 via the transmission gear 51, and the pressuring roller 23 is configured to rotate when rotation of the driving source 52 is transmitted to the pressuring roller 23 via the transmission gear 51. That is, the driving source 52 is configured to rotate the pressuring roller 23.

As shown in FIG. 2, the pressuring roller 23 is provided with a core material 53 of a columnar shape (solid shape) and an elastic layer 54 provided around this core material 53, for example. The core material 53 of the pressuring roller 23 is made of metal such as aluminum, for example. The elastic layer 54 of the pressuring roller 23 is made of foamed silicon rubber having a diameter of 20 mm, a thickness of 5 mm and the hardness of 44°, for example. The elastic layer 54 of the pressuring roller 23 has a higher friction coefficient than that of the core material 53 of the pressuring roller 23.

The heating roller 24 is formed in a cylindrical shape elongated in the forward and backward directions. The heating roller 24 is configured such that the fixing belt 22 is sandwiched between the heating roller 24 and the pressuring roller 23. The heating roller 24 is provided with a base material layer 61 and a coating layer covering this base material layer 61. The base material layer 61 of the heating roller 24 is made of aluminum having a diameter of 15 mm and a thickness of 1 mm, for example. The coating layer 62 of the heating roller 24 is made of silicon rubber having a thickness of 50 μm, for example. The coating layer 62 of the heating roller has a higher friction coefficient than that of the base material layer 61 of the heating roller 24. The coating layer 62 of the heating roller 24 comes into contact with an inner circumference face of the fixing belt 22.

The both front and rear end parts of the heating roller 24 are axially supported by the supporting pieces 37 of the upper frame 32 (see FIG. 3) via bearings (not shown). Thus, the heating roller 24 is supported by the upper frame 32 so that the heating roller 24 is rotatable around a rotation axis S (see FIG. 3) extending in the forward and backward directions. That is, in the present embodiment, the forward and backward directions are a rotation axis direction of the heating roller 24.

Figure 4A:
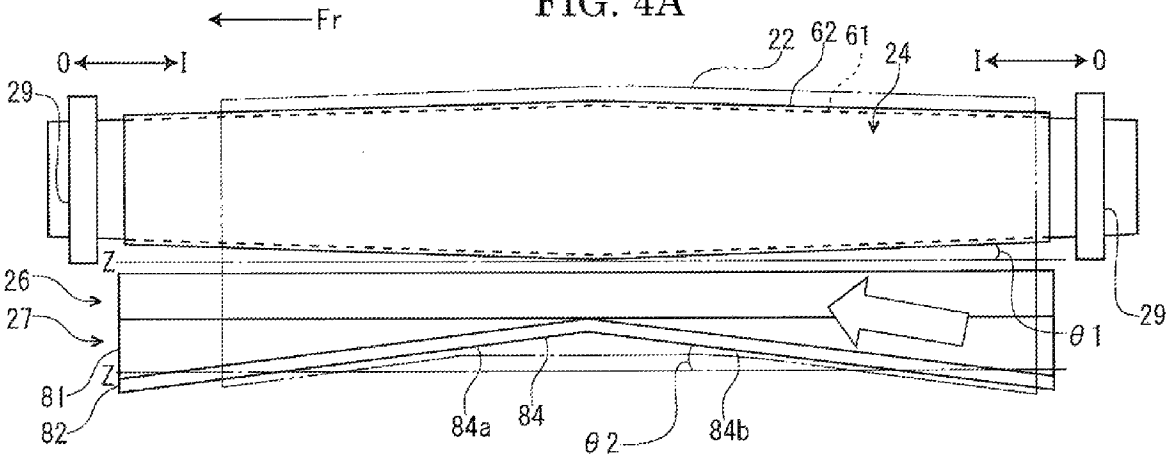
FIG. 4A is a schematic plan view showing a situation where a fixing belt is moved to a rear end side, in the fixing device according to the embodiment of the present disclosure.
Figure 4B:
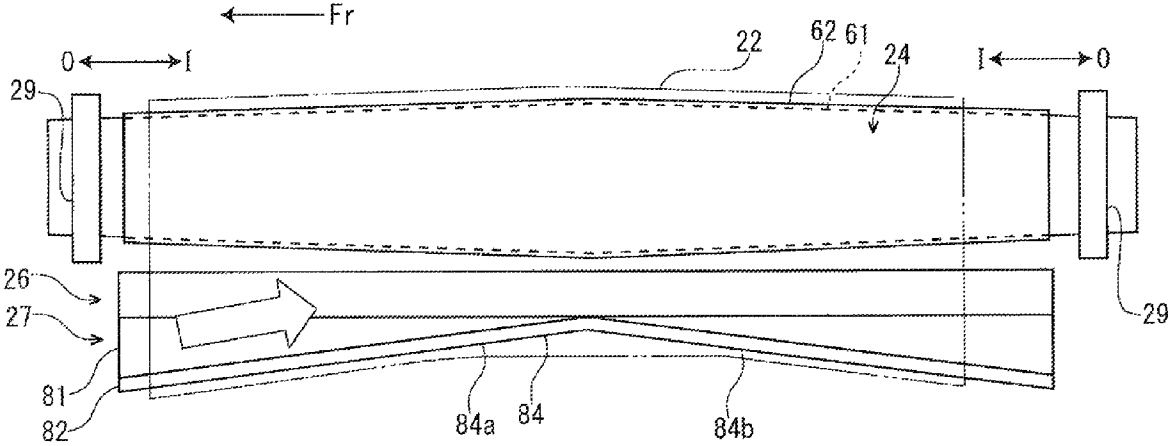
FIG. 4B is a schematic plan view showing a situation where the fixing belt is moved to a front end side, in the fixing device according to the embodiment of the present disclosure.

As shown in FIGS. 4A and 4B, the heating roller 24 is formed in a so-called "regular crown shape", and the diameter of the heating roller 24 is linearly expanded from both end sides to a center side of the fixing belt 22 in the forward and backward directions. Hence, a portion, which is in contact with the fixing belt 22, of an outer circumference face of the heating roller 24 is inclined toward an outside in the radial direction of the fixing belt 22 from the both end sides to the center side of the fixing belt 22 in the forward and backward directions. An inclination angle θ1 of the outer circumference face of the heating roller 24 with respect to the forward and backward directions (see one-dot chain lines Z in FIG. 4A) is $0.01° \leq \theta 1 \leq 0.1°$, for example.

The heater 25 is formed in a shape elongated in the forward and backward directions. As shown in FIG. 2, the heater 25 is housed in a center part of the heating roller 24. The heater 25 is a halogen heater of 800 W, for example. The heater 25 is configured to generate heat by energization, and heat the heating roller 24. The both front and rear end parts of the heater 25 are inserted in the attachment groove 38 of each supporting pieces 37 of the upper frame 32 (see FIG. 3). Thus, the heater 25 is supported by the upper frame 32.

Figure 5:
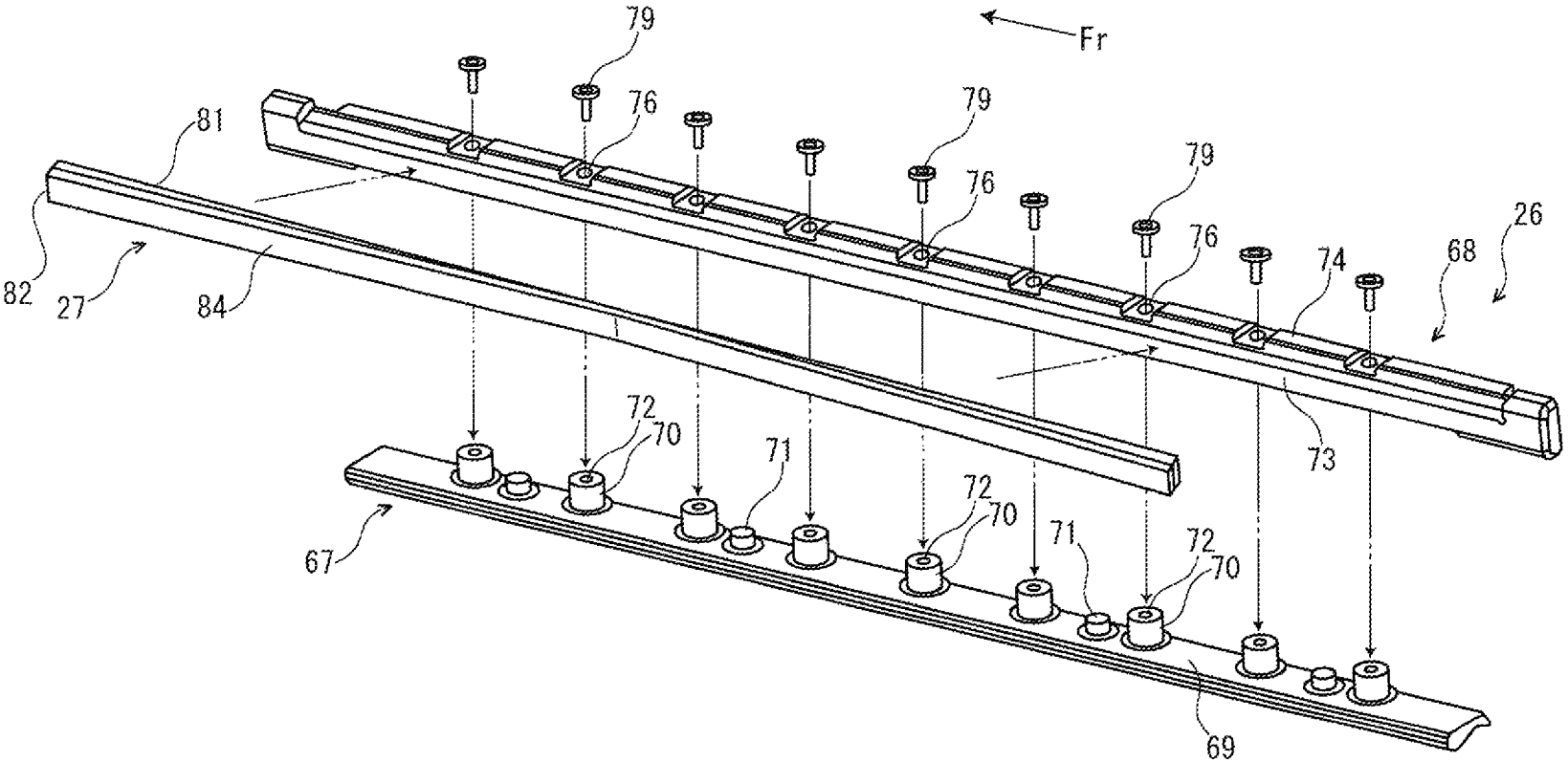
FIG. 5 is an exploded perspective view showing a pressing member and a supporting member, in the fixing device according to the embodiment of the present disclosure.

The pressing member 26 is formed in a shape elongated in the forward and backward directions. The both front and rear end parts of the pressing member 26 are fixed to each upper side base plate 34 of the upper frame 32 (see FIG. 3). Thus, the pressing member 26 is supported by the upper frame 32. As shown in FIGS. 2 and 5, the pressing member 26 is provided with a pressing body 67, and an attachment body 68 located at an upper side of the pressing body 67.

The pressing body 67 of the pressing member 26 is made of heat-resistant resin such as liquid crystal polymer or PPS (polyphenylene sulfide) or metal such as SUS or iron, for example. The pressing body 67 is configured such that the fixing belt 22 is sandwiched between the pressing body 67 and the pressuring roller 23. The pressing body 67 presses the fixing belt 22 toward a lower side (the side of the pressuring roller 23).

The pressing body 67 is provided with a base part 69 and a plurality of projecting parts 70 formed in a top face of the base part 69. The base part 69 is formed in a flat shape elongated in the forward and backward directions. In the top face of the base part 69, projection parts 71 are formed between a plurality of projecting parts 70. A lower face of the base part 69 is curved in an arc shape along the outer circumference face of the pressuring roller 23. A left face (heating roller 24 side face) of the base part 69 is inclined to the left side (the side of the heating roller 24) toward the lower side (the side of the pressuring roller 23). A plurality of projecting parts 70 are formed at intervals in the forward and backward directions. Each projecting part 70 is formed in a columnar shape. In a top face of each projecting part 70, a screw hole 72 is formed.

The attachment body 68 of the pressing member 26 is made of metal such as aluminum, SUS or iron. The attachment body 68 is formed in a shape elongated in the forward and backward directions. The attachment body 68 has a function of a base frame which supports the pressing body 67.

The attachment body 68 is provided with a sidewall part 73 extending in the vertical direction, and an upper wall part 74 bent from an upper end of the sidewall part 73 to the left side (inside in the left and right directions). In the upper wall part 74, a plurality of through-holes 76 are formed in upper and lower directions at intervals in the forward and backward directions. Further, a screw 79 which penetrates each through-hole 76 is screwed to the screw hole 72 of each projecting part 70, so that the attachment body 68 is attached to the pressing body 67.

The supporting member 27 is formed in a shape elongated in the forward and backward directions. As shown in FIG. 2, the supporting member 27 is not configured such that the fixing belt 22 is sandwiched between the supporting member 27 and the pressuring roller 23. The supporting member 27 is located at an upstream side of a fixing nip 90, which is described later, in a rotation direction (see the arrow A in FIG. 2) of the fixing belt 22. The lower face (a downstream side face in the rotation direction of the fixing belt 22) of the supporting member 27 is supported by a reinforcement plate sandwiched between the pressing body 67 and the attachment body 68 of the pressing member 26.

As shown in FIG. 5 and other figures, the supporting member 27 is provided with a fixing body 81 and an elastic body 82 fixed to the right face (external face) of the fixing body 81. The fixing body 81 is made of metal such as aluminum, SUS or iron, or heat-resistant resin such as liquid crystal polymer or PPS (polyphenylene sulfide). The fixing body 81 is fixed to the right face (external face) of the sidewall part 73 of the attachment body 68 of the pressing member 26. As shown in FIGS. 4A, 4B and other figures, the diameter of the fixing body 81 is reduced from the both end sides to the center side of the fixing belt 22 in the forward and backward directions. Hence, the right face (external face) of the fixing body 81 is linearly inclined toward the left side (the inside in the radial direction of the fixing belt 22) from the both end sides to the center side of the fixing belt 22 in the forward and backward directions.

The elastic body 82 is made of an elastic material such as silicon sponge, for example. The elastic body 82 is formed to have the same width from a front end side to a rear end side. At the right face (external face) of the elastic body 82, a supporting face 84 is formed. The supporting face 84 comes into contact with the inner circumference face of the fixing belt 22, and supports the fixing belt 22 from the inside in the radial direction. The supporting face 84 is linearly inclined toward the left side (the inside in the radial direction of the fixing belt 22) from the both end sides to the center side of the fixing belt 22 in the forward and backward directions, and is formed in a V shape. A whole area of the supporting face 84 is inclined. An inclination angle θ2 of the supporting face 84 with respect to the forward and backward directions (see one-dot chain lines Z in FIG. 4A) is $0.3° \leq \theta 2 \leq 5.0°$, for example, and is larger than the inclination angle θ1 of the outer circumference face of the heating roller 24 with respect to the forward and backward directions.

Figure 6:
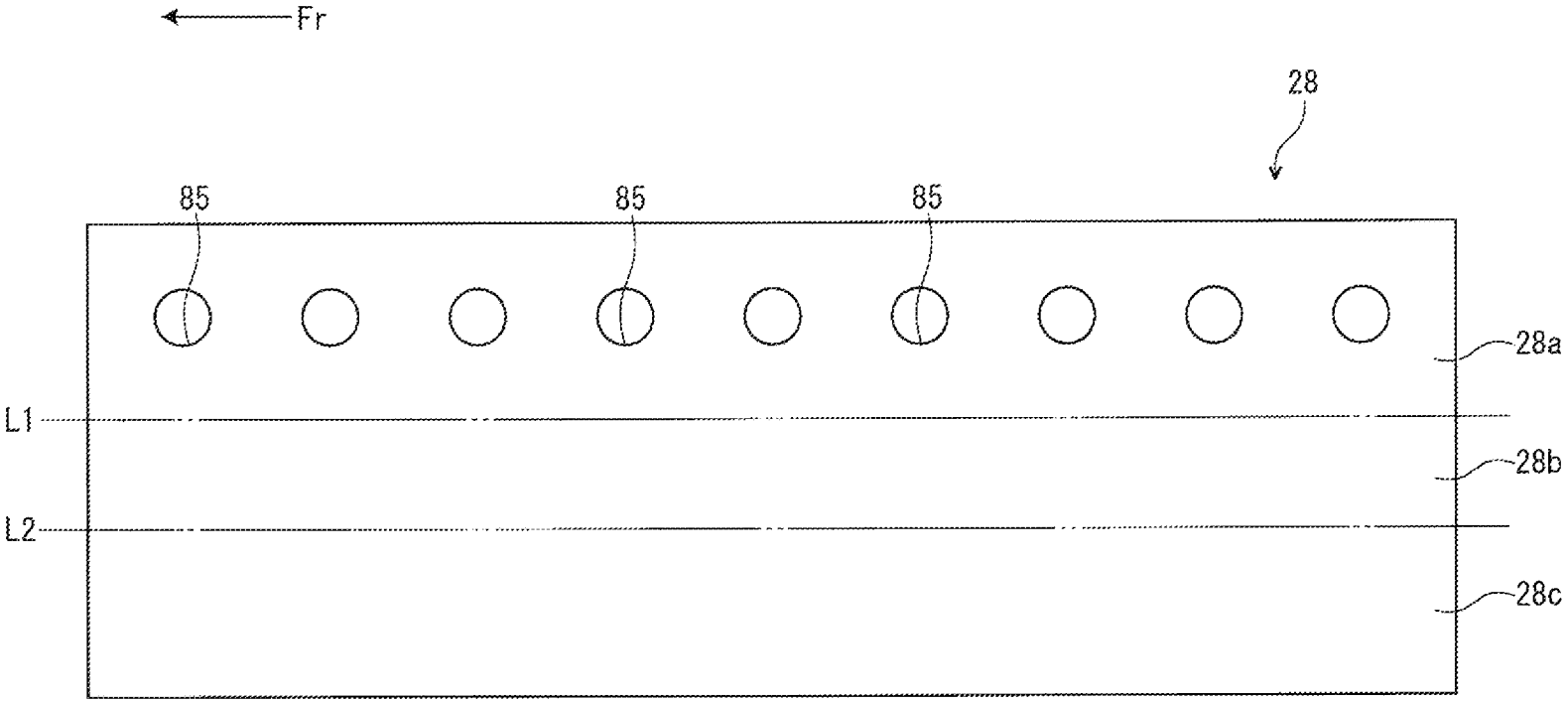
FIG. 6 is a plan view showing a sheet member with a developed state, in the fixing device according to the embodiment of the present disclosure.

As shown in FIG. 6, the sheet member 28 is formed in a shape elongated in the forward and backward directions. The sheet member 28 is made of a low-friction material such as a glass cloth sheet, and has a lower friction coefficient than those of the pressing member 26 and the supporting member 27. To a surface of the sheet member 28, a coating of fluorine resin such as PFA is applied. In addition, a two-dot chain line L1 in FIG. 6 indicates a boundary between a one side part 28*a* in the width direction and a center part 28*b* in the width direction of the sheet member 28, and a two-dot chain line L2 in FIG. 6 indicates a boundary between the center part 28*b* in the width direction and another side part 28*c* in width direction of the sheet member 28. In the one side part 28*a* in the width direction of the sheet member 28, a plurality of attachment holes 85 are formed at intervals in the forward and backward directions. As shown in FIG. 2, each projecting part 70 of the pressing body 67 of the pressing member 26 penetrates through each attachment hole 85. Thus, the one side part 28*a* in the width direction of the sheet member 28 is fixed to the pressing member 26. The one side part 28*a* in the width direction of the sheet member 28 is sandwiched between the pressing body 67 and the attachment body 68 of the pressing member 26. The center part 28*b* in the width direction of the sheet member 28 comes into contact with the right face (external face) of the base part 69 of the pressing body 67 of the pressing member 26. The other side part 28*c* in width direction of the sheet member 28 is sandwiched between a lower face of the base part 69 of the pressing body 67 of the pressing member 26 and the inner circumference face of the fixing belt 22.

As shown in FIGS. 4A and 4B, the respective flanges 29 are provided at front and rear end parts of the base material layer 61 of the heating roller 24. The flanges 29 are located outside of the both front and rear end parts of the fixing belt 22 in the forward and backward directions. Each flange 29 engages with each regulating plate 39 of the upper frame 32 (see FIG. 3) so that the movement of each flange 29 in the forward and backward directions is restricted.

As shown in FIG. 2, at a part at which the fixing belt 22 and the pressuring roller 23 come into pressure contact, the fixing nip 90 is formed. The fixing nip 90 is provided with a first nip part 91, a second nip part 92 formed at the right side of the first nip part 91, and a third nip part 93 formed between the first nip part 91 and the second nip part 92.

The first nip part 91 is formed at a portion at which the fixing belt 22 is sandwiched between the pressuring roller 23 and the heating roller 24. The first nip part 91 is backed up by the heating roller 24 from the inside of the fixing belt 22 in the radial direction. A formation width of the first nip part 91 is 1.5 mm, for example.

The second nip part 92 is formed at a portion at which the fixing belt 22 is sandwiched between the pressuring roller 23 and the pressing body 67 of the pressing member 26. The second nip part 92 is backed up by the pressing body 67 of the pressing member 26 from the inside of the fixing belt 22 in the radial direction. The second nip part 92 is provided at an upstream side of the first nip part 91 in the rotation direction (see the arrow A in FIG. 2) of the fixing belt 22. A total sum of force to be applied to the second nip part 92 is larger than a total sum of force to be applied to the first nip part 91. That is, a force with which the fixing belt 22 is sandwiched between the pressuring roller 23 and the pressing body 67 of the pressing member 26 is larger than a force with which the fixing belt 22 is sandwiched between the pressuring roller 23 and the heating roller 24. A formation width of the second nip part 92 is 9 mm, for example.

The third nip part 93 is provided at a position meeting a gap 94 formed between a lower end part of the heating roller 24 and a lower end part of the base part 69 of the pressing body 67 of the pressing member 26. Hence, the third nip part 93 is not backed up from the inside of the fixing belt 22 in the radial direction. A formation width of the third nip part 93 is 1.5 mm, for example.

In the fixing device 18 configured as described above, when a toner image is fixed to a sheet, the driving source 52 is driven. When the driving source 52 is driven in this way, rotation of the driving source 52 is transmitted to the pressuring roller 23 via the transmission gear 51, and the pressuring roller 23 rotates as indicated by an arrow B in FIG. 2. When the pressuring roller 23 is rotated by the driving source 52 in this way, the fixing belt 22 rotates with rotation of the pressuring roller 23 as indicated by the arrow A in FIG. 2. Further, as indicated by an arrow C in FIG. 2, the heating roller rotates with rotation of the fixing belt 22. In addition, the fixing belt 22 rotates from the side of the pressing member 26 to the side of the heating roller 24 in a state where the fixing belt 22 is sandwiched between the pressuring roller 23 and the heating roller 24.

Further, when a toner image is fixed to a sheet, the heater 25 is operated (turned on). When the heater 25 is operated in this way, the heating roller 24 is heated by the heater 25 from the inside in the radial direction, and the fixing belt 22 is heated from the inside in the radial direction by heat transfer from the heating roller 24. When the sheet passes through the fixing nip 90 in this state, a toner image is heated and pressured, and is fixed to the sheet.

By the way, in the fixing device 18 configured as described above, an individual difference of each component or the like inevitably causes a force which moves the fixing belt 22 to one side (a front end side or a rear end side) during rotation of the fixing belt 22. According to this, when the fixing belt 22 is greatly moved to one side, there is a concern that the fixing belt 22 comes into contact with the flanges 29 arranged outside of the both front and rear end parts of the fixing belt 22 in the forward and backward directions and thereby the fixing belt 22 is buckled or damaged. Hence, in the present embodiment, the fixing belt 22 is prevented from being greatly moved to one side as follows.

FIG. 4A shows a state where the fixing belt 22 is moved to the rear end side. As described above, the supporting face 84 is inclined toward the left side from the both end sides to the center side of the fixing belt in the forward and backward directions. Therefore, when the fixing belt 22 is moved to the rear end side as described above, a force to slide the fixing belt 22 to the center side in the forward and backward directions is caused (see an outlined arrow in FIG. 4A). Hence, the fixing belt 22 slides to the center side in the forward and backward directions with respect to the supporting face 84, so that the fixing belt 22 is prevented from being greatly moved to the rear end side.

Meanwhile, FIG. 4B shows a state where the fixing belt 22 is moved to the front end side. The supporting face 84 is inclined toward the left side from the both end sides to the center side of the fixing belt 22 in the forward and backward directions as described above. Therefore, when the fixing belt 22 is moved to the front end side as described above, a force to slide the fixing belt 22 to the center side in the forward and backward directions is caused (see an outlined arrow in FIG. 4B). Hence, the fixing belt 22 slides to the center side in the forward and backward directions with respect to the supporting face 84, so that the fixing belt 22 is prevented from being greatly moved to the front end side.

In the present embodiment, when the fixing belt 22 is moved to one side (the front end side or the rear end side) as described above, it is possible to cause a force to slide the fixing belt 22 to the center side in the forward and backward directions, and prevent the fixing belt 22 from being greatly moved to one side. According to this, it is possible to prevent the fixing belt 22 from coming into contact with the flanges 29 arranged outside of the both front and rear end parts of the fixing belt 22 in the forward and backward directions, and prevent the fixing belt 22 from being buckled or damaged.

Further, the diameter of the heating roller 24 is expanded from the both end sides to the center side of the fixing belt 22 in the forward and backward directions. By applying such a configuration, it is possible to make a line velocity of the heating roller 24 on the center side of the fixing belt 22 in the forward and backward directions higher than a liner velocity of the heating roller 24 on the both end sides of the fixing belt 22 in the forward and backward directions. According to this, it is possible to increase a force to slide the fixing belt 22 to the center side in the forward and backward directions, and more reliably prevent the fixing belt 22 from being greatly moved to one side.

Further, a part, which is in contact with the fixing belt 22, of the outer circumference face of the heating roller 24 is inclined toward the outside in the radial direction of the fixing belt 22 from the both end sides to the center side of the fixing belt 22 in the forward and backward directions. By contrast, the supporting face 84 is inclined toward the inside in the radial direction of the fixing belt 22 from the both end sides to the center side of the fixing belt 22 in the forward and backward directions. That is, a part, which is in contact with the fixing belt 22, of the outer circumference face of the heating roller 24 is inclined in an opposite way to the supporting face 84. By applying such a configuration, it is possible to slide the fixing belt 22 to the center side in the forward and backward directions at a part at which the fixing belt 22 slides with respect to the supporting face 84, and pull the fixing belt 22 to the center side in the forward and backward directions at a part at which rotation is transmitted from the fixing belt 22 to the heating roller 24. According to this, it is possible to more reliably prevent the fixing belt 22 from being greatly moved to one side.

Further, the inclination angle θ2 of the supporting face 84 with respect to the forward and backward directions (the rotation axis direction of the heating roller 24) is larger than the inclination angle θ1 of the outer circumference face of the heating roller 24 with respect to the forward and backward directions (the rotation axis direction of the heating roller 24). By applying such a configuration, it is possible for the supporting face 84 to sufficiently have a function of sliding the fixing belt 22 to the center side in the forward and backward directions.

Further, the elastic body 82 (a part which composes the supporting face 84) of the supporting member 27 is made of an elastic material. Consequently, it is possible to increase stability of contact between the inner circumference face of the fixing belt 22 and the supporting face 84.

Further, the pressing member 26 is provided with the pressing body 67 which presses the fixing belt 22 toward the lower side (the side of the pressuring roller 23) and the attachment body 68 which is attached to the pressing body 67, and the supporting member 27 is fixed to the attachment body 68. By applying such a configuration, it is possible to reliably fix the supporting member 27 to the pressing member 26.

Further, the reinforcement plate 83 is sandwiched between the pressing body 67 and the attachment body 68, and this reinforcement plate 83 supports a lower face (a downstream side face in the rotation direction of the fixing belt 22) of the supporting member 27. By applying such a configuration, it is possible to prevent the supporting member 27 from being displaced to the downstream side in the rotation direction of the fixing belt 22 with rotation of the fixing belt 22.

Further, the supporting member 27 is located at the upstream side of the fixing nip 90 in the rotation direction of the fixing belt 22. By applying such a configuration, it is possible to place the supporting face 84 in contact with the inner circumference face of a part, to which a great tension is applied, of the fixing belt 22. According to this, it is possible to enhance an effect that the supporting face 84 slides the fixing belt 22 to the center side in the forward and backward directions.

Further, in the present embodiment, the coating layer 62 of the heating roller 24 having a higher friction coefficient than that of the base material layer 61 of the heating roller 24 comes into contact with the inner circumference face of the fixing belt 22. By applying such a configuration, the pressuring roller 23 and the heating roller 24 can strongly grip the fixing belt 22, and the first nip part 91 of the fixing nip 90 can pull the fixing belt 22 to the left side (the downstream side in the rotation direction of the fixing belt 22). According to this, the fixing belt 22 is stretched between the first nip part 91 and the second nip part 92 of the fixing nip 90. Consequently, it is possible to effectively prevent the fixing belt 22 from being deflected or buckled at the third nip part 93 of the fixing nip 90 and suppress image deterioration.

Figure 7A:
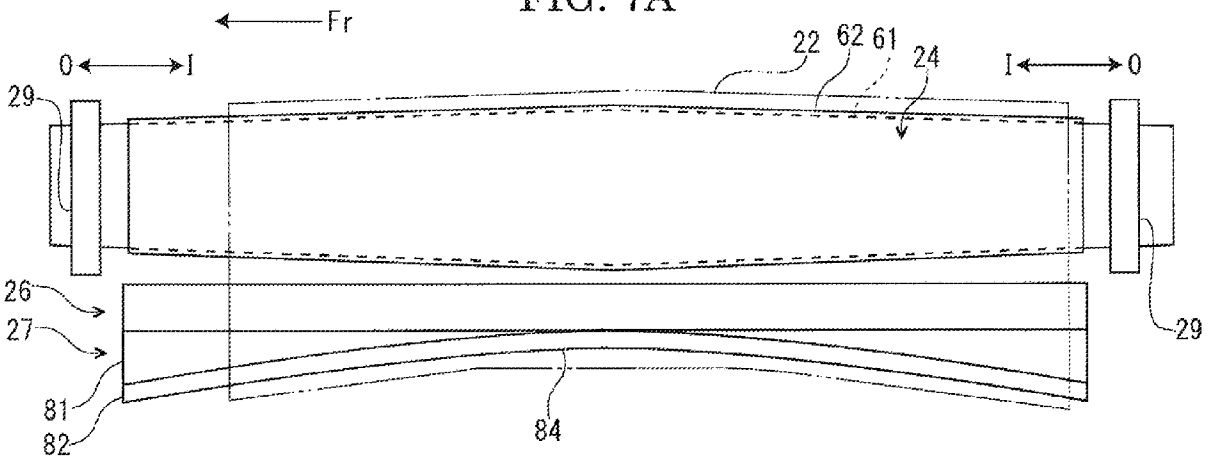
FIGS. 7A and 7B are schematic plan views each showing a fixing device according to another embodiment of the present disclosure.

In the present embodiment, a case where the supporting face 84 is linearly inclined and the supporting face 84 is formed in a V shape has been described. Meanwhile, in other different embodiments, as shown in FIG. 7A, the supporting face 84 may be inclined in a curved shape and formed in a U shape.

Figure 7B:
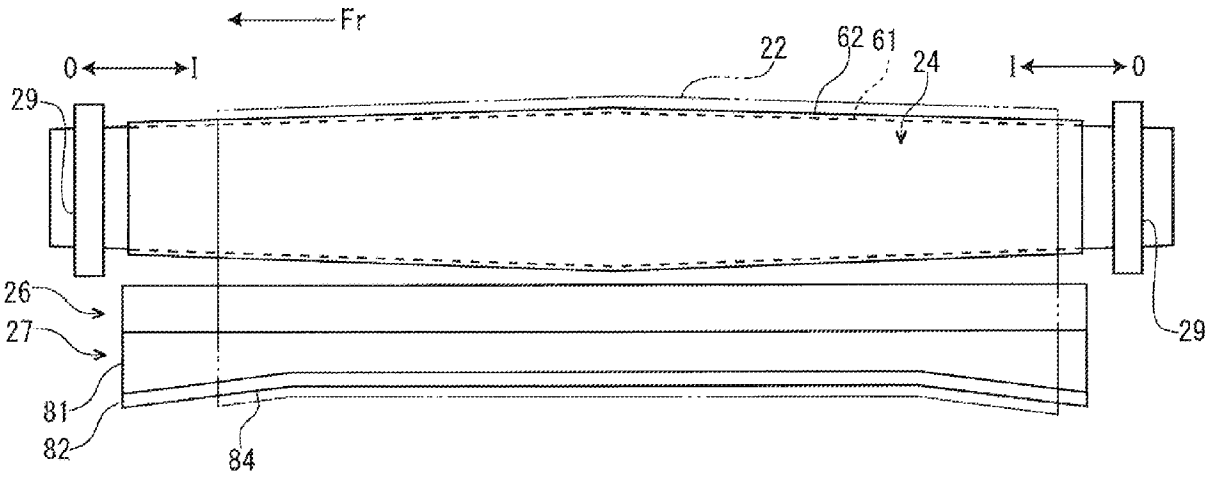

In the present embodiment, a case where the whole area of the supporting face 84 is inclined with respect to the forward and backward directions (the rotation axis direction of the heating roller 24) has been described. Meanwhile, in the other different embodiments, as shown in FIG. 7B, a part (e.g. a part outside in the forward and backward directions) of the supporting face 84 may be inclined with respect to the forward and backward directions (the rotation axis direction of the heating roller 24).

Figure 8:
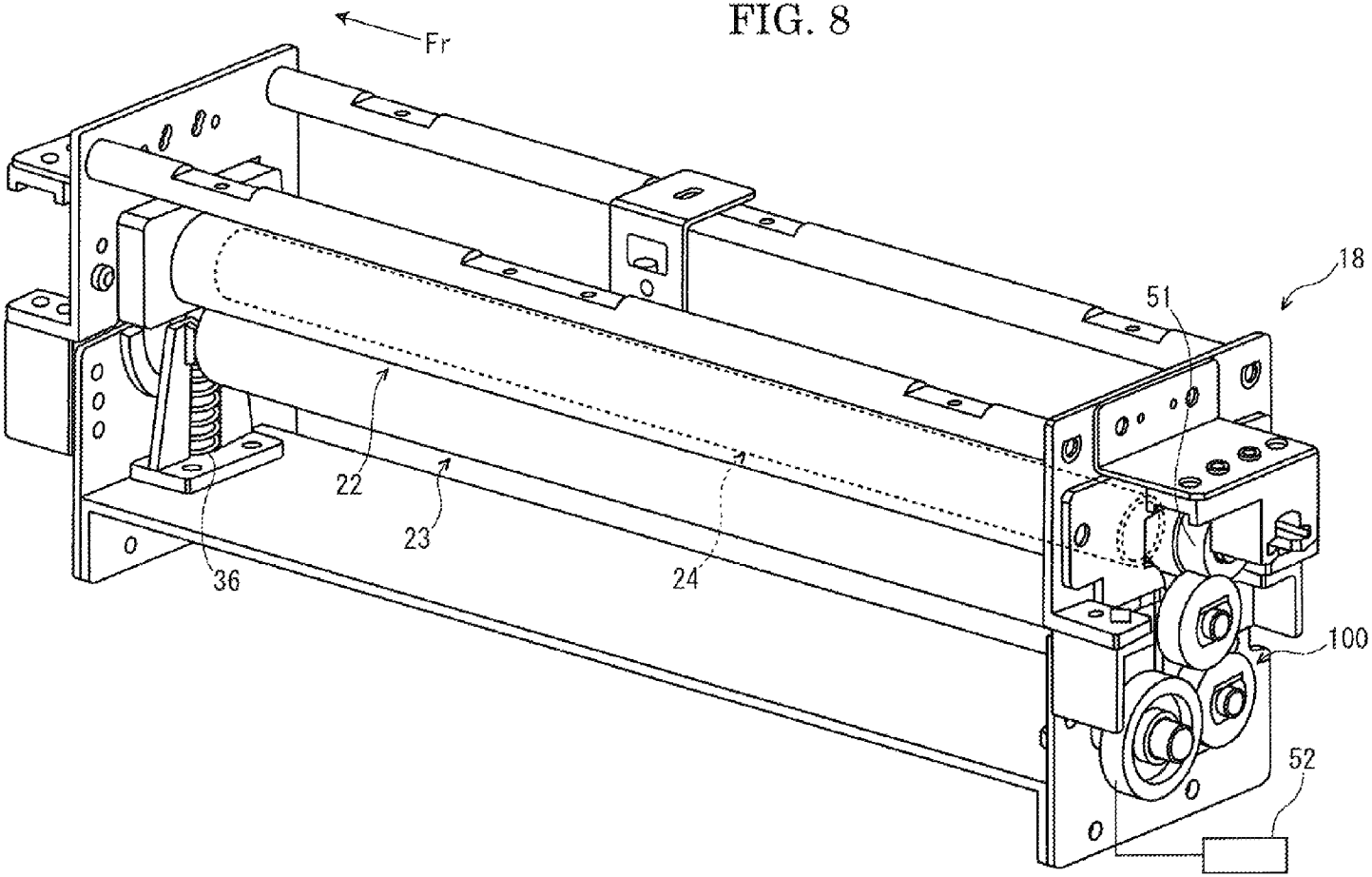
FIG. 8 is a perspective view showing a fixing device according to still another embodiment of the present disclosure.

In the present embodiment, a case where the transmission gear 51 is fixed to the pressuring roller 23 and the driving source 52 is connected to the pressuring roller 23 via this transmission gear 51 has been described. Meanwhile, in the other different embodiments, as shown in FIG. 8, the transmission gear 51 may be fixed to the heating roller 24, and the driving source 52 may be connected to the heating roller 24 via this transmission gear 51 and a gear train 100. In this case, when the heating roller 24 is rotated by the driving source 52, the fixing belt 22 and the pressuring roller 23 rotate with the rotation of the heating roller 24.

In the present embodiment, a case where the fixing belt 22 is biased to the lower side (the side of the pressuring roller 23) by the coil springs 36 (biasing members) has been described. Meanwhile, in the other different embodiments, as shown in FIG. 8, the pressuring roller 23 may be biased to the upper side (the side of the fixing belt 22) by the coil springs 36 (biasing members).

In the present embodiment, a case where the supporting member 27 is located at the upstream side of the fixing nip 90 in the rotation direction of the fixing belt 22 has been described. Meanwhile, in the other different embodiments, the supporting member 27 may be located at the downstream side of the fixing nip 90 in the rotation direction of the fixing belt 22.

In the present embodiment, a case where the supporting member 27 and the pressing member 26 are separately provided has been described. Meanwhile, in the other different embodiments, a part or the entirety of the supporting member 27 may be provided integrally with the pressing member 26.

In the present embodiment, a case where the fixing belt 22 is provided around the heating roller 24, the pressing member 26 and the supporting member 27 in a state where the upper part of the fixing belt 22 is loose has been described. Meanwhile, in the other different embodiments, the fixing belt 22 may be provided around the heating roller 24, the pressing member 26 and the supporting member 27 in a state without any looseness.

In the present embodiment, a case where the base material layer of the fixing belt 22 is made of resin (PI (polyimide)) has been described. Meanwhile, in the other different embodiments, the base material layer of the fixing belt 22 may be made of metal such as SUS or nickel.

In the present embodiment, a case where the pressuring roller 23 is provided with the core material 53 and the elastic layer 54 has been described. Meanwhile, in the other different embodiments, the pressuring roller may be provided with the core material 53 and the elastic layer 54, and, in addition, a release layer covering the elastic layer 54. The release layer of the pressuring roller 23 is made of a PFA tube, for example.

In the present embodiment, a case where the heater 25 composed of the halogen heater is used as a heat source has been described. Meanwhile, in the other different embodiments, a carbon heater, a ceramic heater or an IH (Induction Heating) coil or the like may be used as the heat source.

In the present embodiment, a case where the configuration of the present disclosure is applied to the printer 1 has been described. Meanwhile, in the other different embodiments, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressuring member arranged rotatably and configured to come into pressure contact with the fixing belt so as to form a fixing nip;

a heating member arranged rotatably around a rotation axis and configured such that the fixing belt is sandwiched between the heating member and the pressuring member;

a pressing member configured to press the fixing belt to a side of the pressuring member and configured such that the fixing belt is sandwiched between the pressing member and the pressuring member; and a supporting member having a supporting face configured to come into contact with the inner circumference face of the fixing belt, the supporting face being inclined toward inside in a radial direction of the fixing belt from both end sides to a center side of the fixing belt in the rotation axis direction, wherein diameter of the heating member is expanded from the both end sides to the center side of the fixing belt in the rotation axis direction, and wherein an inclination angle of the supporting face with respect to the rotation axis direction is larger than an inclination angle of an outer circumference face of the heating member with respect to the rotation axis direction.

2. The fixing device according to claim 1, wherein the supporting face is formed at a part of the supporting member and at least the part of the supporting member is made of an elastic material.

3. The fixing device according to claim 1, wherein the supporting member is located at an upstream side of the fixing nip in a rotation direction of the fixing belt.

4. The fixing device according to claim 1, wherein a whole area of the supporting face is inclined.

5. The fixing device according to claim 1, wherein only a part of the supporting face is inclined.

6. The fixing device according to claim 1, further comprising a heat source located inside of the heating member in a radial direction.

7. An image forming apparatus comprising the fixing device according to claim 1.

8. A fixing device comprising:

a fixing belt arranged rotatably;

a pressuring member arranged rotatably and configured to come into pressure contact with the fixing belt so as to form a fixing nip;

a heating member arranged rotatably around a rotation axis and configured such that the fixing belt is sandwiched between the heating member and the pressuring member;

a pressing member configured to press the fixing belt to a side of the pressuring member and configured such that the fixing belt is sandwiched between the pressing member and the pressuring member; and a supporting member having a supporting face configured to come into contact with the inner circumference face of the fixing belt, the supporting face being inclined toward inside in a radial direction of the fixing belt from both end sides to a center side of the fixing belt in the rotation axis direction, wherein the pressing member includes:

a pressing body configured to press the fixing belt to the side of the pressuring member; and an attachment body attached to the pressing body, and the supporting member is fixed to the attachment body, the fixing device further comprising a reinforcement plate sandwiched between the pressing body and the attachment body, wherein a downstream side face of the supporting member in a rotation direction of the fixing belt is supported by the reinforcement plate.

* * * * *